US005700983A

United States Patent [19]

VonDross

[11] Patent Number: 5,700,983

[45] Date of Patent: Dec. 23, 1997

[54] SOUND ATTENUATING STRUCTURAL BLOCK

[75] Inventor: Kelly L. VonDross, Waukesha, Wis.

[73] Assignee: Best Block Company, Butler, Wis.

[21] Appl. No.: 703,064

[22] Filed: Aug. 26, 1996

[51] Int. Cl.[6] ..... E04B 1/00; E04B 1/82

[52] U.S. Cl. ..... 181/285; 181/286; 181/293

[58] Field of Search ..... 181/284, 285, 181/286, 293; 52/144, 145, 606

[56] References Cited

U.S. PATENT DOCUMENTS

| | | | |
|---|---|---|---|
| D. 291,601 | 8/1987 | D'Antonio et al. | D25/160 |
| D. 306,764 | 3/1990 | D'Antonio et al. | D25/160 |
| 2,933,146 | 4/1960 | Zaldastani et al. | 181/285 |
| 3,506,089 | 4/1970 | Junger | 181/285 |
| 3,837,426 | 9/1974 | Kleinschmidt | 181/285 |
| 3,866,001 | 2/1975 | Kleinschmidt et al. | 181/285 |
| 4,071,989 | 2/1978 | Warren | 181/285 |
| 4,269,013 | 5/1981 | West | 52/405.1 |
| 4,319,661 | 3/1982 | Proudfoot | 181/295 |
| 4,499,142 | 2/1985 | Kingston | 428/331 |
| 4,562,901 | 1/1986 | Junger et al. | 181/285 |
| 4,821,839 | 4/1989 | D'Antonio et al. | 181/198 |
| 4,833,852 | 5/1989 | West | 52/405.1 |
| 4,964,486 | 10/1990 | D'Antonio et al. | 181/285 |
| 5,027,920 | 7/1991 | D'Antonio et al. | 181/285 |
| 5,168,129 | 12/1992 | D'Antonio | 181/30 |
| 5,193,318 | 3/1993 | D'Antonio et al. | 181/285 |
| 5,226,267 | 7/1993 | D'Antonio et al. | 181/285 |
| 5,401,921 | 3/1995 | D'Antonio et al. | 181/286 |

OTHER PUBLICATIONS

Proudfoot Company Inc., "Soundblox—Sound-Absorbing Structural Masonry Units" 1995 (no month).

Proudfoot Company, Inc. Spec-Data "Sound Absorbing Masonry Units" 1964 (no month).

Trenwyth Acoustical Products, "Acousta-Wal—Sound Absorbing Masonry Units" 1982 (no month).

RPG Diffuser Systems, Inc. "Diffusorblox—The First Radically New Development in Acoustical Concrete Masonry Technology in 30 Years" (no date).

West Materials, Inc., "Enerblock—Insulating Concrete Masonry" (no date).

*Primary Examiner*—Eddie C. Lee

*Attorney, Agent, or Firm*—Andrus, Sceales, Starke & Sawall

[57] ABSTRACT

A structural block useful in constructing a wall for absorbing sound. The structural block includes a pair of internal cavities which are separated by a center wall. A pair of angled front walls are positioned along the front surface of the structural block. The block further includes a pair of acoustical openings. The first acoustical opening is located in the center wall, while the second acoustical opening is located in one of the end walls. Each of the pair of acoustical openings provides a path for sound to travel from the exterior of the structural block into the pair of internal cavities, where the sound is dampened. Preferably, the structural block contains a pair of retaining grooves on each of the end walls and on each side of the side wall to retain a sound attenuator which can be positioned within each of the internal cavities.

28 Claims, 10 Drawing Sheets

SOUND ATTENUATING STRUCTURAL BLOCK

FIELD OF THE INVENTION

The invention relates to the construction and configuration of a structural block. More specifically, the invention relates to a cinder or concrete block having a pair of angled front walls and a pair of acoustical openings, the block being particularly useful in dampening the sound contacting a wall constructed of a plurality of the structural blocks.

BACKGROUND OF THE INVENTION

Concrete blocks, such as those commonly referred to as cinder blocks, have long been used to construct buildings and other sturdy structures. The conventional concrete block has a generally flat front and back face surface connected by a series of perpendicular side walls or webs to create a pair of internal cavities. The pair of internal cavities typically have an open top and an open bottom, and are filled with air. The internal air cavities and the pair of face surfaces create a structure which is both insulating and sound isolating. In a room constructed of these blocks, the flat face surface of the typical concrete block acts to reflect sound, causing sound to be reflected within a room in an undesirable manner, often creating an echo.

Many different sound absorbing structural blocks, labeled acoustic masonry units, have been constructed in an attempt to alleviate the problem of reflected sound in a room. One popular type of sound absorbing structural block includes a slot or a pair of slots positioned in the flat front wall to provide an acute acoustic path between the internal cavity and the exterior of the block, such as shown in U.S. Pat. Nos. 2,933,146; 3,506,089; 3,837,426; and 3,866,001. Blocks of this type are sold by the Proudfoot Company under the trademark SOUND BLOX® and by Trenwyth Acoustical Products under the name ACOUSTA-WALL™.

While this type of block functions reasonably well to absorb sound at low frequencies, the block has several disadvantages. The first disadvantage of this type of block is that the generally flat face surface tends to reflect any of the sound not entering the internal cavities through the slots in the face surface.

A second problem with the SOUND BLOX® type block has to do with flutter echo, commonly misnamed reverberation or resonance. Flutter echo is characterized by discreet replications of the original source sound between two highly sound reflective surfaces more than 30 feet apart. Since the current sound absorbing blocks contain generally flat face surfaces, flutter echo can be the problem. A known solution to this problem would be to skew the parallel walls in a room such that they would no longer be parallel. However, conventional acoustic masonry units are typically built in parallel walls, and when they are painted, have approximately 93% of their surface area acting as a highly reflective surface to promote flutter echo.

A third problem which may arise with a typical SOUND BLOX® type block occurs when there is a need for a relatively high load bearing wall constructed of these blocks. Typically, when a load bearing wall is constructed of concrete blocks, a steel beam is inserted into the internal cavities which run the entire height of the wall. With the steel beam inserted, concrete is poured into the internal cavity such that a solid wall is formed. However, since conventional acoustic masonry units rely on the open internal cavity to absorb sound, filling these cavities with concrete eliminates their sound attenuating feature.

Therefore, it can be appreciated that a structural block, or acoustic masonry unit, which utilizes a pair of internal cavities to reduce sound energy through absorption while solving the noted problems present in the current acoustic masonry units would be desirable. Particularly, a structural block which solves the above problems and is easy to manufacture and aesthetically pleasing would be particularly desirable.

SUMMARY OF THE INVENTION

The invention is a structural building block which can be used to reduce and absorb the majority of sound energy reaching the block, while providing an irregular shaped front surface for diffusing the remaining portion of the sound energy to minimize undesirable sound reflection. The structural block in accordance with the invention includes a generally planar back wall joined to a pair of end walls or webs that extend perpendicularly from the back wall. The structural block further includes a center wall or web that is joined to the back wall at a position between the pair of end walls. The combination of the back wall, the pair of end walls, and the center wall combine to form a pair of internal cavities within the structural block.

In the preferred embodiment of the invention, a pair of angled front walls are connected between the pair of end walls and the center wall. The first angled front wall is located in a plane that extends at an acute angle with respect to the back wall from the first end wall to the center wall. An acoustical opening is formed in the center wall to provide an acoustical path for sound to enter the internal cavity positioned behind the first front wall. The second angled front wall is located in a plane that extends at an acute angle away from the back wall from the center wall to the second end wall. A second acoustical opening is formed in the second end wall such that sound can enter the second internal cavity through the second acoustical opening.

In the preferred embodiment of the invention, the first end wall has an upper portion and a lower portion, the lower portion being wider than the upper portion. The width of the upper portion of the first end wall corresponds generally to the width of the second end wall from the second acoustical opening to the back wall. Additionally, the length of the center wall from the first acoustical opening to the back wall is also approximately equal to the length of the upper portion of the first end wall. When a pair of blocks are positioned adjacent to one another, the length of the second end wall from the second acoustical opening to the back wall will be positioned adjacent to and corresponds to the length of the upper portion of the first end wall to provide a wall having a uniform appearance.

In this manner, the pair of acoustical openings provide access to the internal cavities of the structural block. In a preferred embodiment of the invention, a retaining means, such as a pair of parallel retaining ridges that define a retaining groove, is formed in each of the end walls and on both sides of the center wall. A sound attenuator, such as a piece of fibrous material, can be positioned between the forwardmost retaining ridge and a notch formed in the end wall and center wall to further aid in the dampening of sound within the internal cavities.

In another alternate embodiment of the invention, a separator can be positioned within the retaining grooves to divide each of the internal cavities into a forward and rear cavity. With the separator in place, the rear portion of each internal cavity can be filled with concrete to form a load bearing wall while the structural block retains its sound absorbing properties.

Other features and advantages of the invention may appear in the course of the following description.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
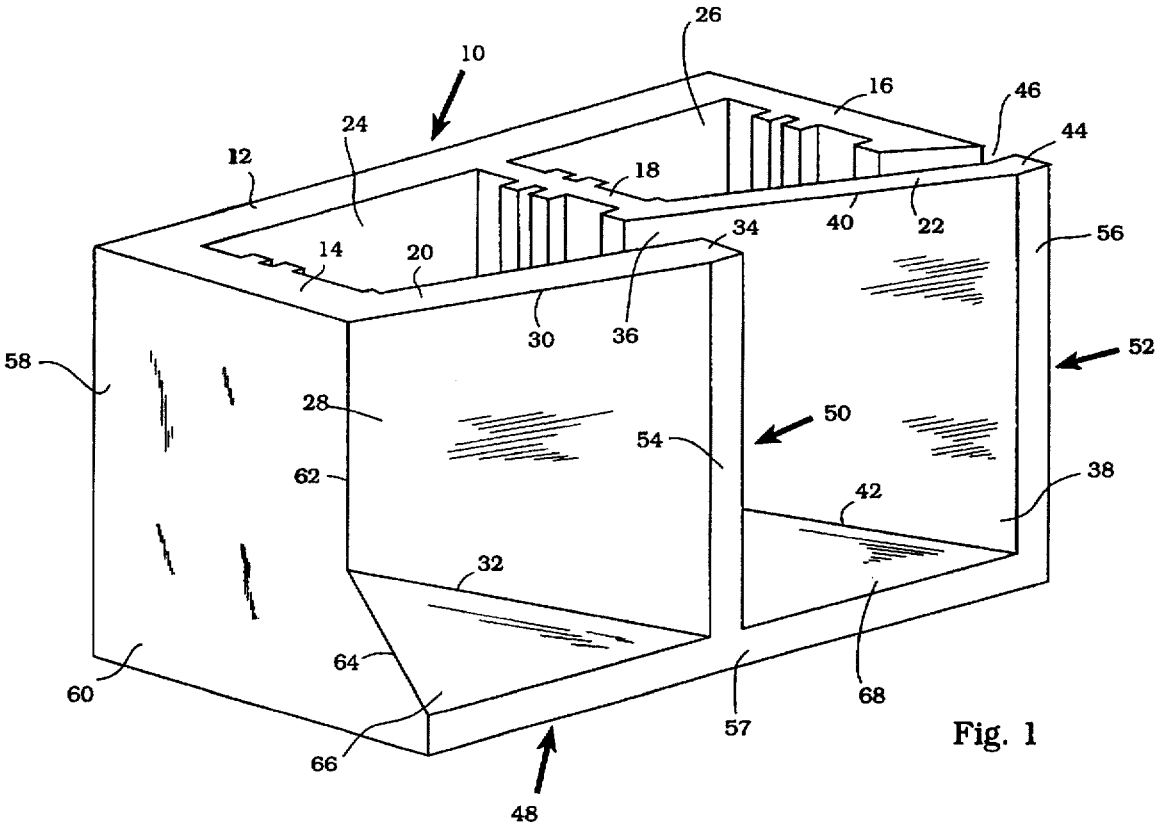
FIG. 1 is a perspective view of a structural block constructed according to the invention.

With reference to FIG. 1, the structural block composed preferably of concrete and constructed according to the invention is generally designated by reference numeral 10. The structural block 10 is generally comprised of a back wall 12, a first end wall or web 14, a second end wall or web 16, a center wall or web 18 and a pair of front walls 20 and 22. As can best be seen in FIGS. 1 and 2, the center wall 18 and the pair of spaced end walls 14, 16 are contiguous with the back wall 12. The combination of the pair of end walls 14, 16 and the center wall 18, along with the pair of front walls 20, 22 and the back wall 12 combine to form a first internal cavity 24 and a second internal cavity 26. The first internal cavity 24 and the second internal cavity 26 are separated by the center wall 18.

Figure 2:
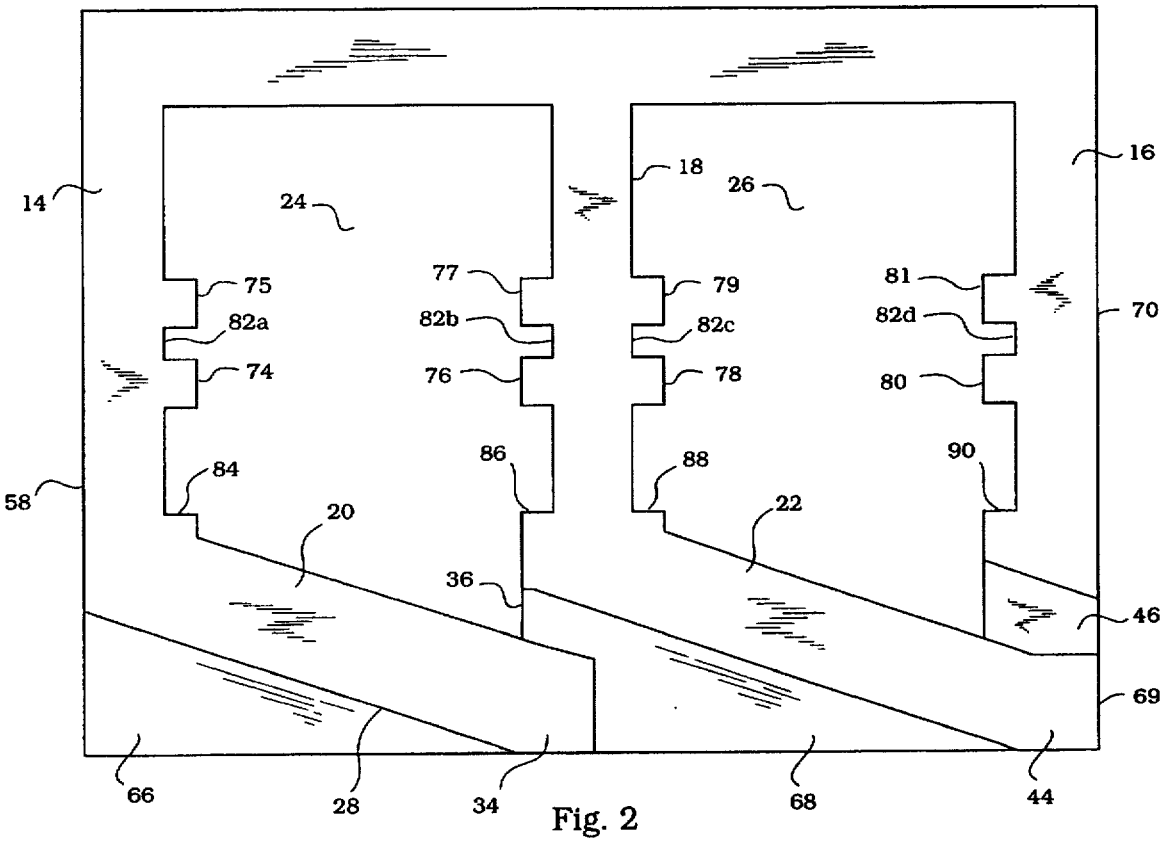
FIG. 2 is a top plan view of the structural block of the invention.
Figure 7:
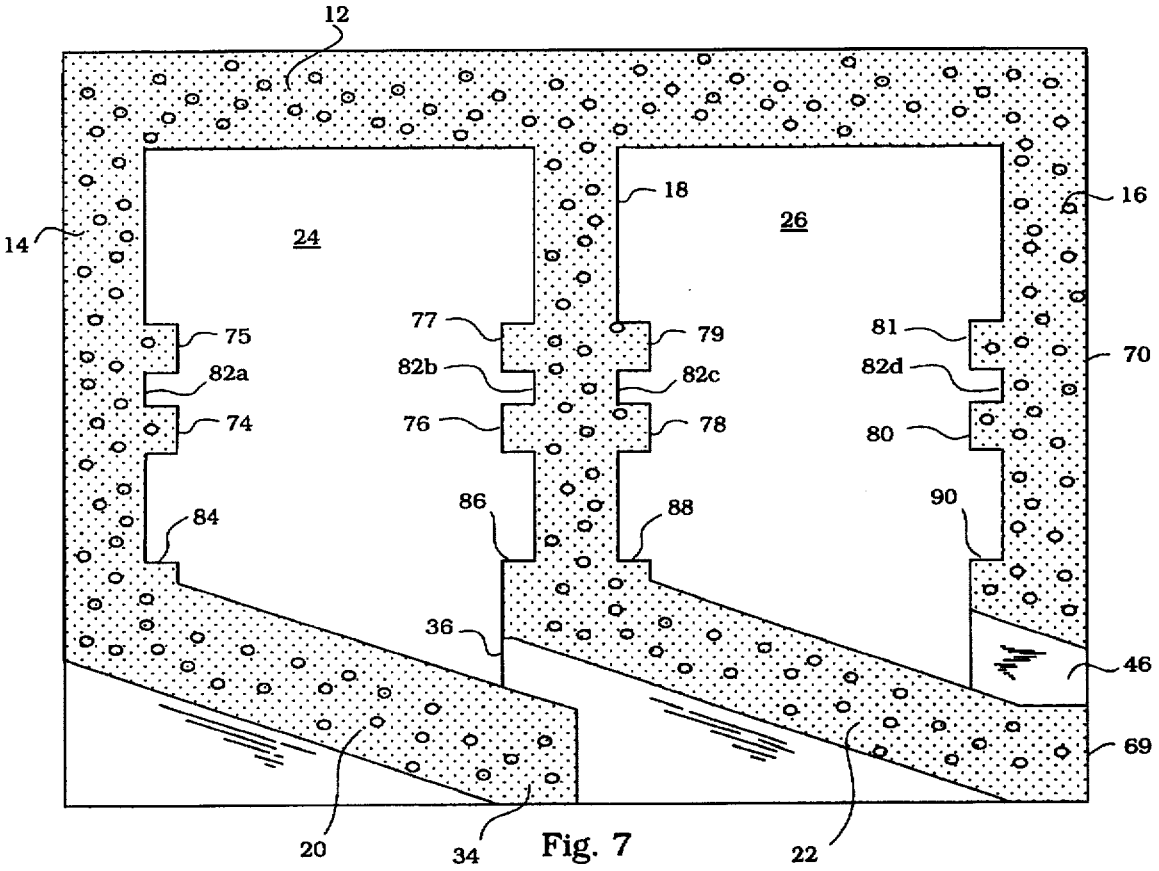
FIG. 7 is a sectional view taken along line 7—7 of FIGS. 4 and 5 of the structural block of the invention.

As can be seen in FIG. 1, the front wall 20 is joined to the first end wall 14 and extends between the first end wall 14 and the center wall 18 and is contained in a plane that is positioned at an acute angle relative to the back wall 12. The connection between the front wall 20 and the center wall 18 cannot be seen in FIG. 1, but can best be understood with reference to FIG. 7. The front wall 20 is comprised of a generally planar front face surface 28 which extends between an upper edge 30 and a lower edge 32. As can be seen in FIG. 2, the front wall 20 terminates at a forward end 34 which is actually a portion of the center wall 18. The forward end 34 of the front wall 20 is spaced from the remaining portion of center wall 18 by a first acoustical opening 36. As shown in FIGS. 2 and 7, the first acoustical opening 36 provides an acoustical path for sound to enter the first internal cavity 24. The first acoustical opening 36 extends downward from the top surface of the block 10 until it terminates at a location above the bottom surface of the block, such that the height of the acoustical opening 36 is less than the height of the block 10.

Referring again to FIG. 1, the second front wall 22 consists of a front face surface 38 extending between an upper edge 40 and an angled lower edge 42. The front wall 22 is integrally joined to the center wall 18 and is positioned in a plane which extends at an acute angle away from the back wall 12 to a position where its forward end 44 is joined to the second end wall 16. In the preferred embodiment of the invention, the angle between each of the front walls 20, 22 and the back wall 12 is approximately 19°. although the angle could be modified while still operating under the scope of the invention,.

As can best be seen in FIG. 2, the connection between front wall 22 and the center wall 18 is spaced from the forward end 34 of the front wall 20 by the first acoustical opening 36. The forward end 44 of the front wall 22 is spaced from the remaining portion of the second end wall 16 by a second acoustical opening 46. The second acoustical opening 46 provides an acoustical path for sound to enter the second internal cavity 26 from the exterior of the block 10. The second acoustical opening 46 extends downward into the end wall 16 from the top surface of the block 10 until it terminates at a location above the bottom surface of the block 10, such that the height of the second acoustical opening 46 is less than the height of the block 10.

Figure 3:
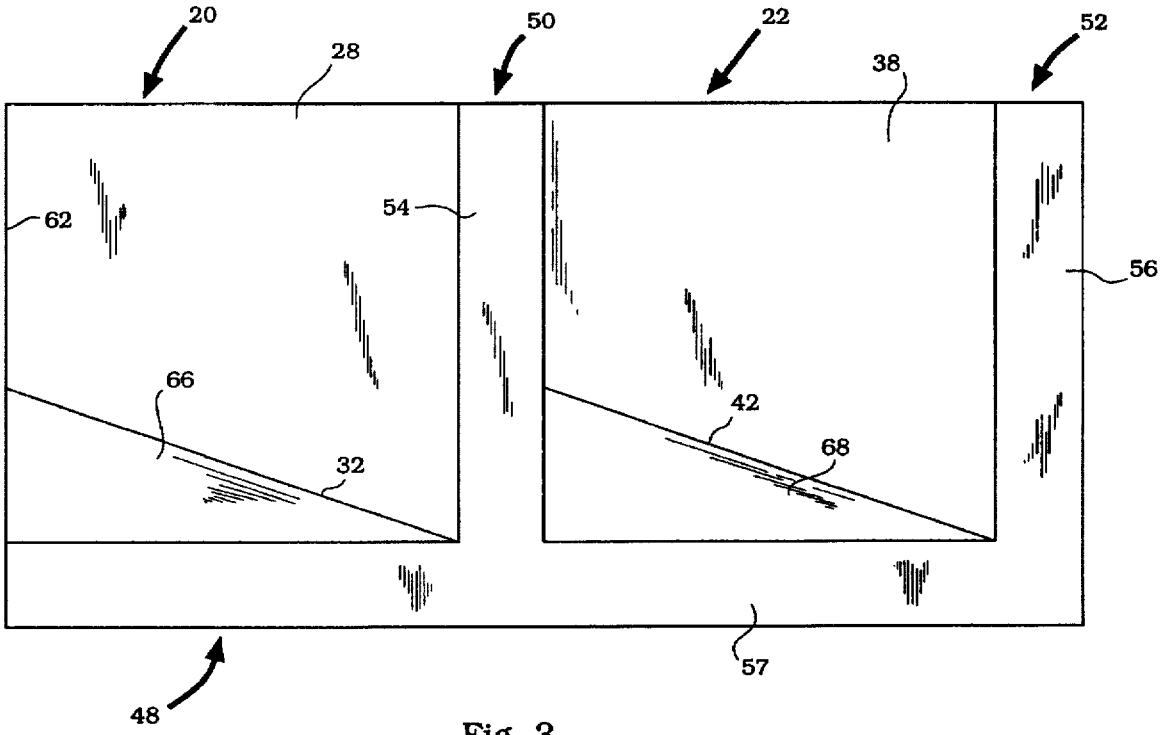
FIG. 3 is a front plan view of the structural block of the invention.

Referring now to FIGS. 1 and 3, the block 10 further includes a lower front rail 48 which extends along the bottom of the block 10 and is generally parallel to the back wall 12. Joined to the lower front rail 48 are the forward end 34 of the front wall 20 and the forward end 44 of the front wall 22. The forward ends 34 and 44 define a pair of vertical uprights 50, 52 each of which have a generally flat front surface 54, 56 which lie in the same plane as the front face surface 57 of the lower front rail 48 to facilitate stacking and alignment of adjacent blocks 10 in a wall.

Figure 4:
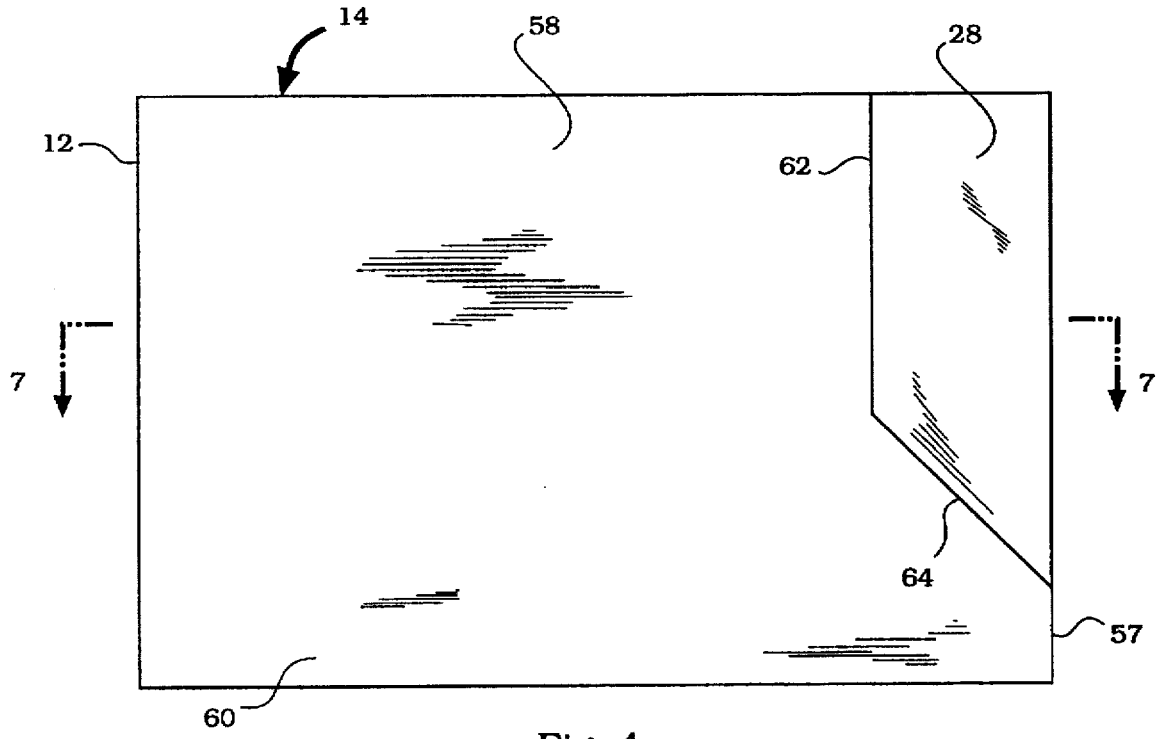
FIG. 4 is a side view of the structural block of the invention.

Referring to FIGS. 1 and 4, it can be seen that the first end wall 14 contains an upper portion 58 and a lower portion 60. The upper portion 58 is defined by the back wall 12 and a vertical front edge 62. The lower portion 60 of the first end wall 14 is defined by the back wall 12, the flat front face surface 57 of the lower front rail 48 and an angled front edge 64. The angled front edge 64 extends between the vertical front edge 62 and the front face surface 57.

The front face surface 28 of front wall 20 extends from the vertical front edge 62 of the end wall 14 to the flat front surface 54 of vertical upright 50 contained on the center wall 18 and is bounded by the angled lower edge 32. The angled lower edge 32 extends downward and forward from the point of intersection of the upper portion 58 and the lower portion 60 of the first end wall 14, which is defined by the intersection between the vertical front edge 62 and the angled front edge 64.

As shown in FIGS. 1 and 3, a front inclined surface 66 is positioned between the lower front rail 48 and the front face surface 28. The front inclined surface 66 joins the front face surface 28 along the lower edge 32 of the face surface 28, and is further defined by the angled front edge 64 of the end wall 14. A second front inclined surface 68 is positioned between the lower front rail 48 and the second front wall 22 (FIG. 3). The second front inclined surface 68 joins the front face surface 38 along the lower edge 42 and extends upward to a location where it defines the bottom of the first acoustical opening 36.

Figure 5:
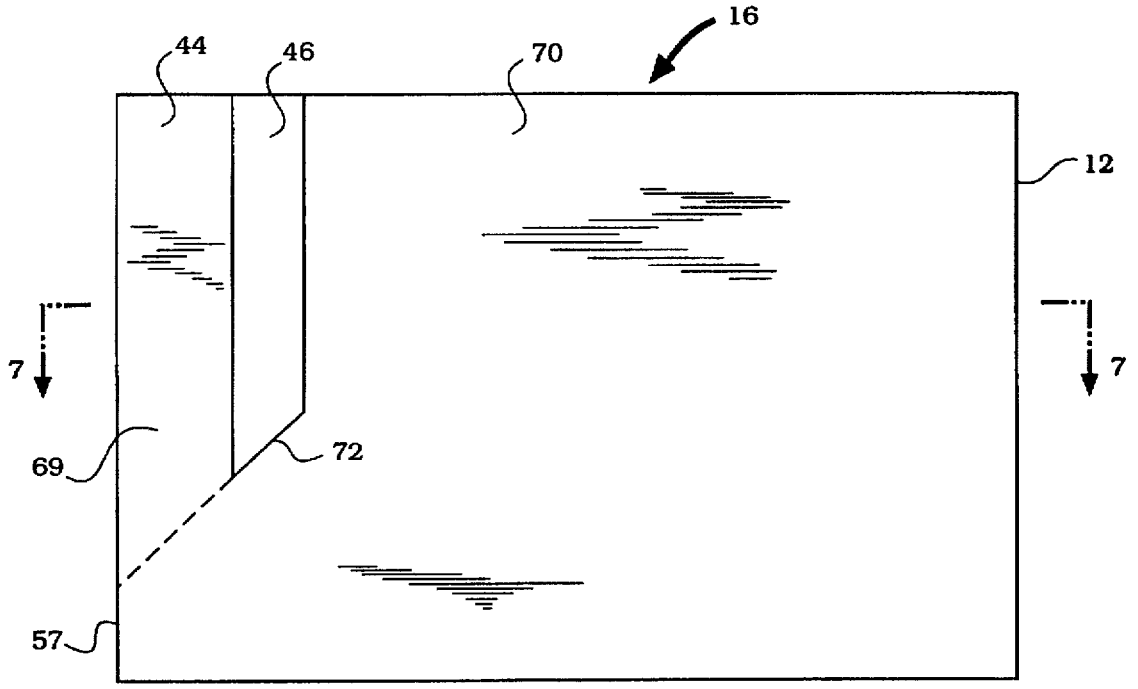
FIG. 5 is the opposite side view of the structural block of the invention.

Shown in FIG. 5 is the second end wall 16. As can be appreciated by comparing FIGS. 4 and 5, the second end wall 16 is nearly a mirror image of the first end wall 14, except for the solid forward end 44 of the front wall 22. The forward end 44 contains a generally flat side face surface 69 that lies in the same general plane as the outer surface of the side wall 16. The second end wall 16 includes an upper portion 70 having a length defined by the distance between the second acoustical opening 46 and the back wall 12. As can be seen in FIG. 5, the second acoustical opening 46 has a height which corresponds to only a portion of the overall height of the second end wall 16, such that the block 10 can maintain its structural load bearing strength. The second acoustical opening 46 terminates at an angle at the lower edge 72 that corresponds to the angled front edge 64 shown in FIG. 4. As can best be seen in FIG. 2, the upper portion 70 of the second end wall 16 corresponds in length to the upper portion 58 of the first end wall 14, such that when a pair of blocks are positioned side by side, the adjacent first and second end walls of each block are equal, as will be discussed in detail below.

Figure 6:
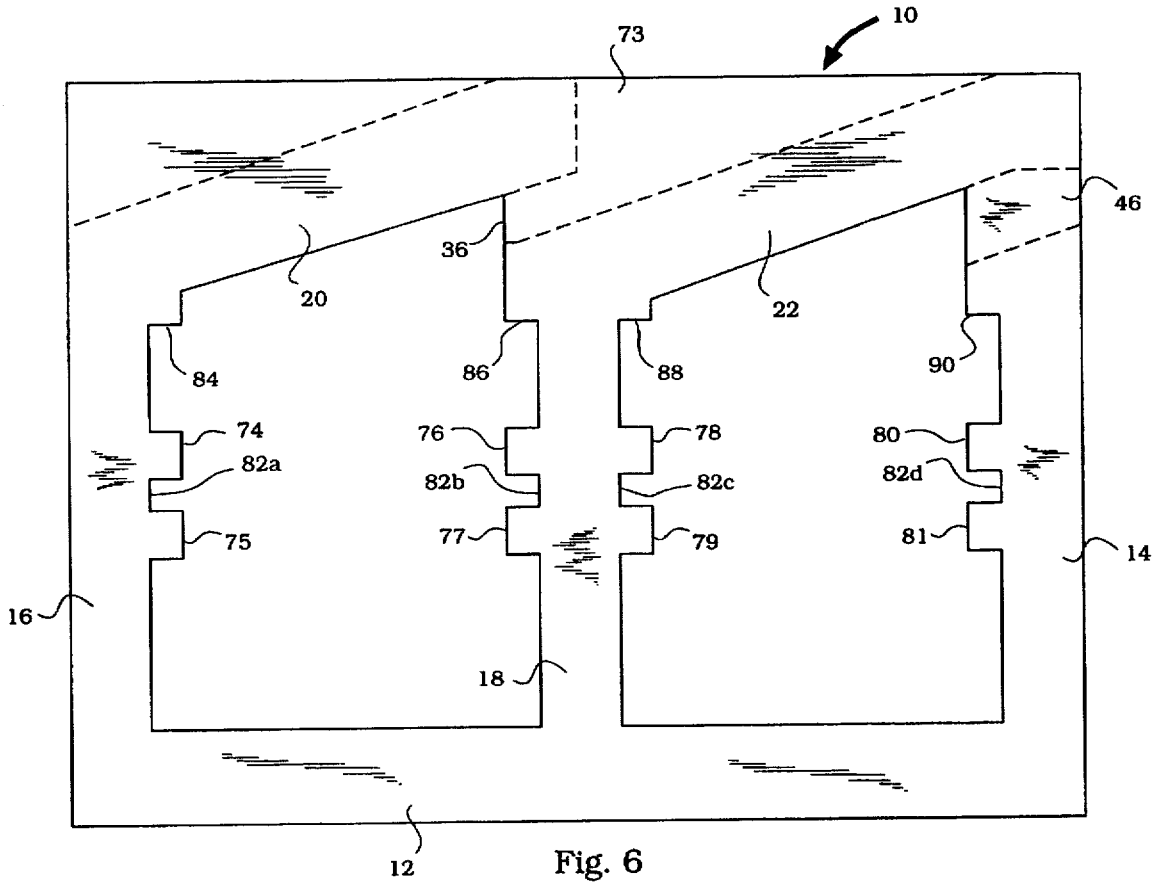
FIG. 6 is a bottom plan view of the structural block of the invention.

Referring now to FIG. 6, it can be seen that the structural block 10 according to the invention is a single contiguous unit. Each of the first and second acoustical openings 36, 46, as indicated by the dashed lines, does not extend the entire height of the structural block 10. Therefore, as can be seen in FIG. 6, the front portion 73 of the structural block 10 is a single solid piece of material from which the front walls 20 and 22 extend upward such that the structural block 10 maintains its structural load bearing strength. Since each of the front walls 20, 22 extend the entire height of the block 10, the block is able to maintain its structural strength and can replace typical concrete blocks without the need for further engineering modifications to the building.

Figure 8:
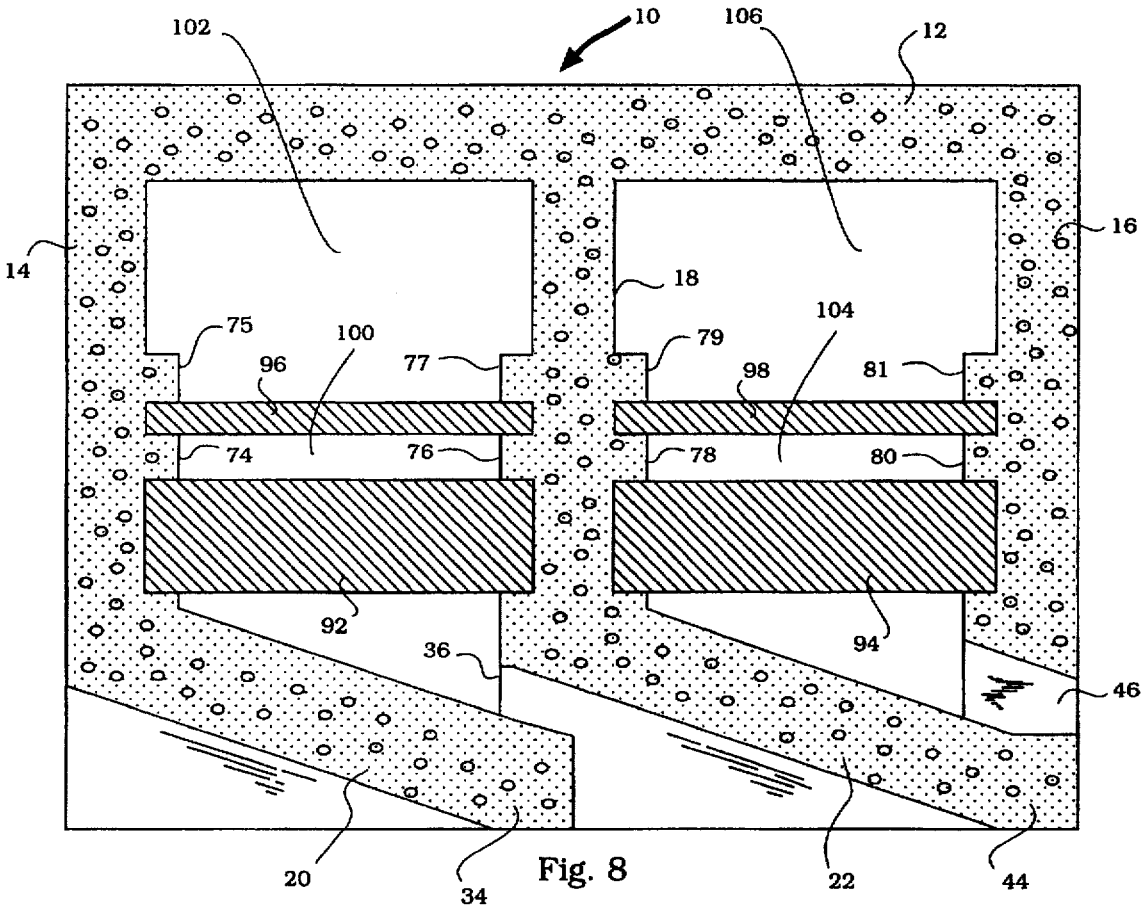
FIG. 8 is a sectional view similar to FIG. 7 showing the incorporation of a sound attenuator and a cavity divider with the structural block of the invention.

In a preferred embodiment of the invention, a retaining means, such as the series of retaining ridges 74–81 that define retaining grooves **82*a*–82*d*, can be formed in the first and second end walls 14, 16 and center wall 18 as best shown in FIGS. 2 and 7. Each of the retaining ridges 74–81 extend vertically over the entire height of the structural block 10 and create a groove 82*a*–*d* between each of the pairs. Ridges having a height less than the overall height of the block 10 could be alternatively used. The retaining ridges 74,76,78 and 80 are useful in connection with the forward notches 84,86,88 and 90 formed in the end walls 14 and 16 and the central wall 18 are used to retain a pair of sound attenuators 92 and 94 between the center wall 18 and the pair of end walls 14,16, as shown in FIG. 8. Each of the sound attenuators 92, 94 preferably have a height which corresponds to the height of block 10, although in an alternate embodiment, the sound attenuators could have a height less than that of the block 10. Preferably, the sound attenuators 92, 94 are each a fibrous sheet of material which act to further absorb sound entering the first and second internal cavities 24, 26**, although alternate materials such as polymeric foam could also be used.

In an alternate embodiment of the invention, a first separator 96 can be positioned between the end wall 14 and center wall 18 and the retaining grooves **82*a* and 82*b*, and a second separator 98 can be positioned between the center wall 18 and the end wall 16 in the retaining grooves 82*c* and 82*d*. Each of the separators 96,98 preferably have a height which corresponds to the height of the block 10. The first separator 96 divides the first internal cavity 24 into a forward portion 100 and a rear portion 102. Likewise, the second separator 98 divides the second internal cavity 26 into a forward portion 104 and a rear portion 106. Preferably, the separators 96,98 are formed of a plastic material, although alternate materials such as plywood could be used. When the separators 96,98 are positioned as shown in FIG. 8, the rear portion 102, 106 of each of the internal cavities can be filled with concrete in order to form a load bearing wall. Since the separators divide each of the internal cavities into a forward and a rear section, when the rear sections 102,106 are filled with concrete to form the load bearing wall, the forward section 100,104 of each cavity can still contain the sound attenutators 92,94 to permit the structural block 10** to absorb sound, as previously discussed.

Figure 9:
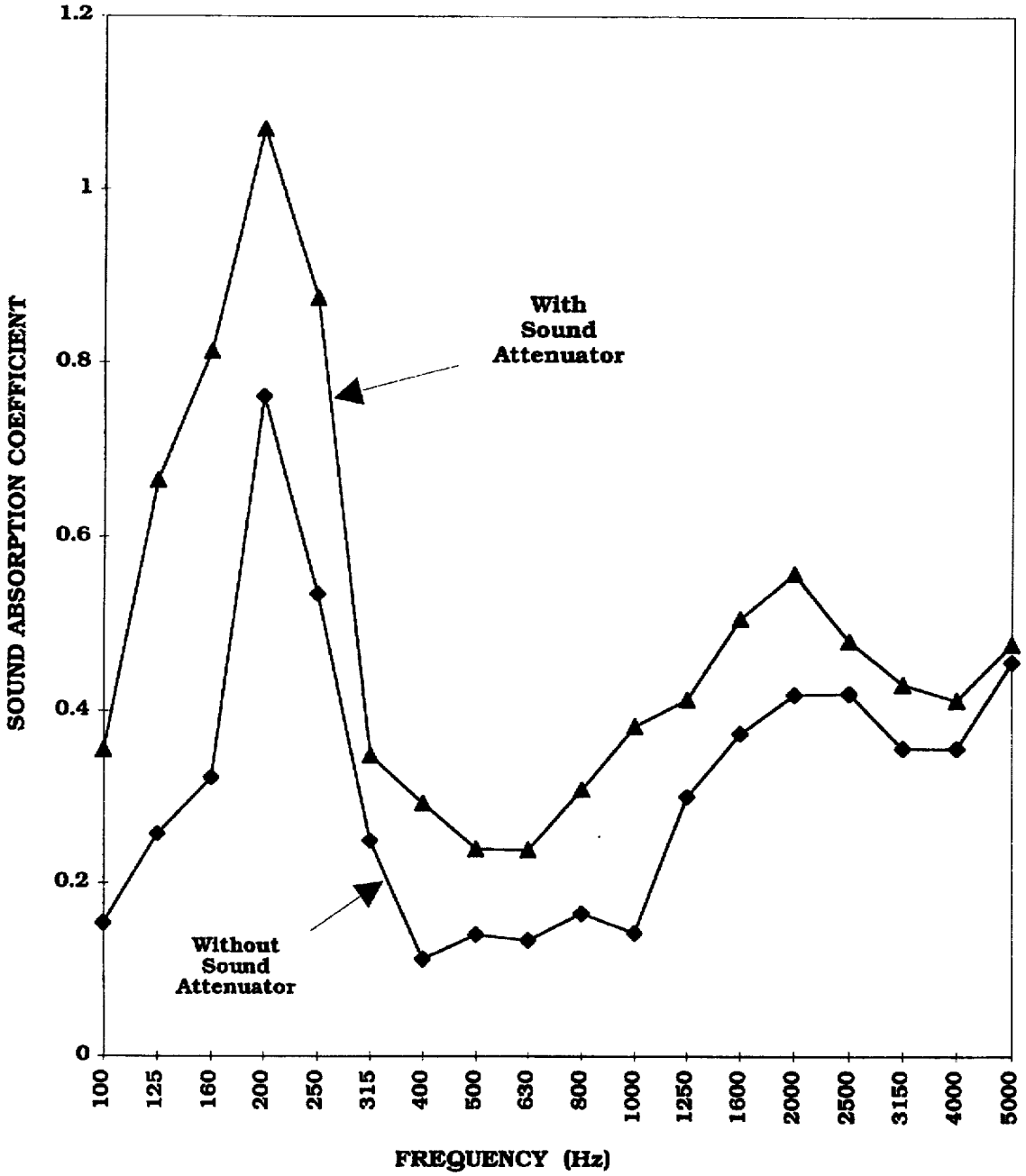
FIG. 9 is a graph showing the sound absorption efficiency as a function of frequency for the structural block with and without a sound attenuator in each internal cavity.

FIG. 9 graphically demonstrates typical values of the sound absorption efficiency as a function of frequency for the structural block with and without the sound attenuators 92, 94. The figure shows that the structural block 10 is particularly effective at absorbing sound in the frequency range of 125–315 Hz. Additionally, the graph of FIG. 9 illustrates that the structural block 10 having the sound attenuators 92, 94 is more efficient at absorbing sound than a similar block without the sound attenuators.

Figure 10:
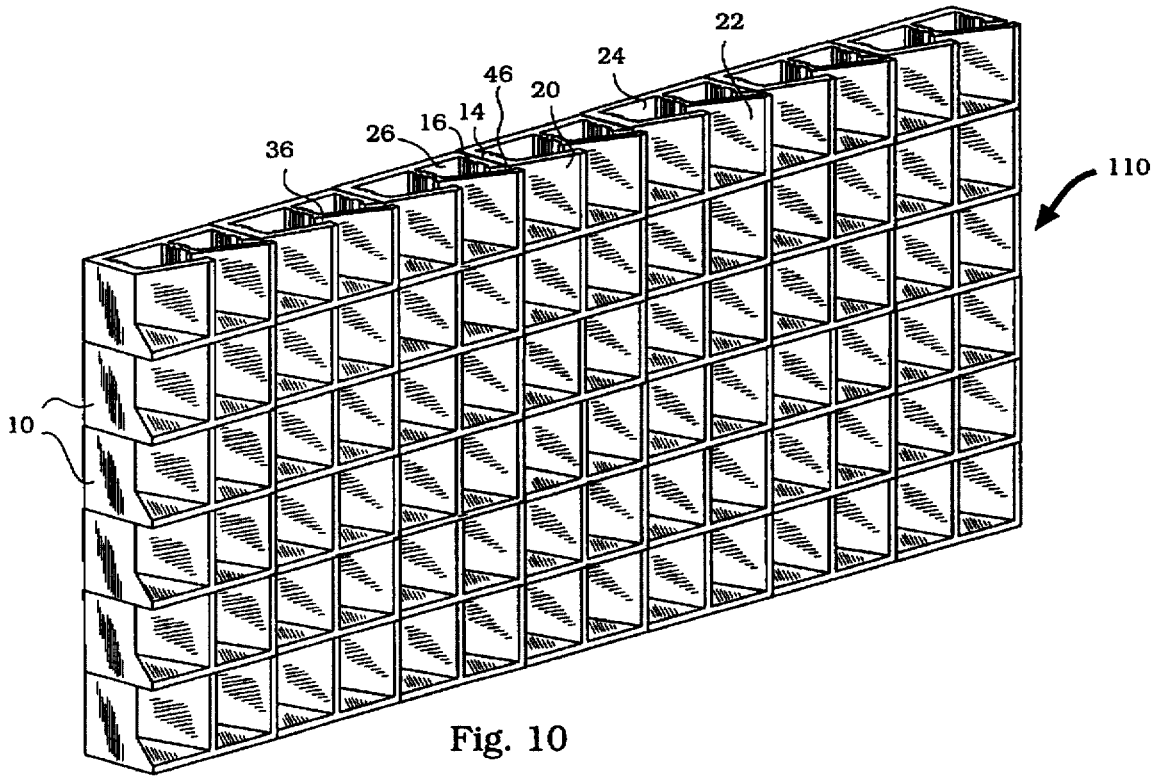
FIG. 10 is a perspective view showing a wall constructed using a plurality of structural blocks of the invention.

Referring now to FIG. 10, the operation of the structural block 10 in attenuating sound when incorporated in a wall will be described. Shown in FIG. 10 is a complete wall 110 incorporating a series of structural blocks 10 constructed according to the invention. The second end wall 16 of one block 10 is positioned adjacent the first end wall 14 of an adjoining block such that the second acoustical opening 46 is open to allow sound to enter the second internal cavity 26.

When sound waves contact the wall 110, the angled front walls 20, 22 act to direct sound waves into the individual blocks 10 through the first and second acoustical openings 36, 46. As previously described, the front wall 20 acts to deflect the sound into the second internal cavity 26 of an adjacent structural block. The front wall 22 deflects sound through the first acoustical opening 36 and into the first internal cavity 24 of the same block. The sound entering the first and second internal cavities 24, 26 resonate within the cavities, which acts as Helmholz resonators to absorb the sound energy, especially low frequency sound waves as the graph of FIG. 9 illustrates. As previously discussed, in the preferred embodiment a sound attenuator 92 and 94 can be positioned within each of the internal cavities 24, 26 to further absorb sound entering therein.

Additionally, the angled front walls 20, 22 and the pair of front inclined surfaces 66, 68 create an irregular shaped front surface that tends to diffuse any sound not entering the first and second acoustical openings 36, 46 to further minimize any undesirable sound reflection. The angled front walls 20, 22 and inclined front surfaces 66, 68 are a vast improvement over the generally flat front face surface in a typical prior concrete block.

In the preferred embodiment of the invention, the structural block 10 has an open top and bottom as shown in the figures. In an alternate embodiment, the block 10 could be constructed having a solid top or bottom wall, or both, while still operating under the scope of the invention.

It is thought that the present invention and its advantages will be understood from the foregoing description, the form of the invention described above being merely a preferred or exemplary embodiment of the invention. It may be apparent that there are changes that can be made without departure from the spirit and scope of the invention and sacrificing all of its material advantages.

I claim:

1. A sound absorbing structural block comprising:

a back wall;

a first and a second side wall contiguous with and extending outwardly from the back wall; and an angled front wall extending between the first and second side walls at an acute angle relative to a plane defined by a portion of the back wall, the back wall, the first and second side walls, and the angled front wall defining an internal cavity, and the second side wall having an acoustical opening formed therein to provide acoustical communication between the internal cavity and the exterior of the structural block.

2. The structural block of claim 1, wherein the internal cavity has an open top and an open bottom.

3. The structural block of claim 1, further comprising a sound attenuator positioned within a retaining means contained on each of the first and second side walls, the sound attenuator extending between the first and second side walls.

4. The structural block of claim 3, wherein the retaining means is a pair of grooves contained on each of the first and second side walls.

5. The structural block of claim 1, wherein the first side wall has an upper and a lower portion, the lower portion having a length greater than the upper portion, the upper portion of the first side wall having a length less than the length of the second side wall such that the angled front wall extends at an acute angle away from the back wall from the upper portion of the first side wall to the second side wall.

6. The structural block of claim 5, wherein the length of the upper section of the first side wall is approximately equal to the length of the second side wall from the back wall to the acoustical opening formed in the second side wall.

7. A sound absorbing structural block comprising:

a back wall;

a first and a second end wall contiguous with the back wall, each end wall extending outwardly from the back wall and spaced from each other;

a center wall joined to the back wall and spaced between the first and second end walls;

a first angled front wall extending between the first end wall and the center wall, the first angled front wall being positioned at an acute angle with respect to the back wall; and a second angled front wall extending between the center wall and the second end wall, the second angled front wall being positioned at an acute angle with respect to the back wall, the back wall, the first and second end walls, the first and second angled front wall, and the center wall combining to form a first and a second internal cavity separated by the center wall, the center wall having a first acoustical opening formed therein providing acoustical communication between the first internal cavity and the exterior of the structural block, and the second end wall having a second acoustical opening formed therein providing acoustical communication between the second internal cavity and the exterior of the structural block.

8. The structural block of claim 7, wherein the first acoustical opening in the center wall is positioned between the first and second angled front walls.

9. The structural block of claim 7, wherein the first and second internal cavities each have an open top and an open bottom.

10. The structural block of claim 7, wherein the first acoustical opening has a height less than the height of the center wall.

11. The structural block of claim 10, wherein the second acoustical opening has a height less than the height of the second end wall.

12. The structural block of claim 7 further comprising a sound attenuator disposed in each cavity, the sound attenuator being a mass of fibrous sound attenuating material.

13. The structural block of claim 12, wherein the sound attenuator is a sheet of fibrous sound attenuating material.

14. The structural block of claim 13, further comprising a pair of retaining grooves formed on each of the first and second end walls and on both sides of the center wall for securely positioning a separator between the first end wall and the center wall and between the second end wall and the center wall.

15. The structural block of claim 14, wherein the separator divides both the first and second internal cavity into a forward and a rear section.

16. The structural block of claim 15, wherein the sound attenuator is disposed in the forward portion of each internal cavity.

17. The structural block of claim 7, wherein the first end wall has an upper portion and a lower portion, the lower portion being longer than the upper portion.

18. The structural block of claim 17, wherein the width of the second end wall between the second acoustical opening and the back wall is substantially equal to the width of the upper portion of the first end wall.

19. The structural block of claim 18, wherein the width of the center wall between the first acoustical opening and the back wall is substantially equal to the width of the upper portion of the first end wall.

20. The structural block of claim 19, wherein the width of the center wall, the second end wall and the lower portion of the first end wall are substantially equal.

21. The structural block of claim 19, wherein the second end wall has an upper portion and a lower portion, the lower portion having a length greater than the upper portion, further comprising a front rail extending between the lower portion of the first end wall and the lower portion of the second end wall, the front rail being generally parallel to the back wall.

22. The structural block of claim 21, further comprising a first and a second inclined surfaces, the first inclined surface extending between the front rail and the first angled front wall, the second inclined surface extending between the front rail and the second angled front wall.

23. The structural block of claim 7, wherein the first and second angled front walls are positioned at an angle of approximately 19° with respect to the back wall.

24. A sound absorbing masonry block comprising:

a generally planar back wall;

a first end wall and a second end wall contiguous with the back wall, each end wall being substantially perpendicular to the back wall and spaced from each other;

a center wall joined to the back wall and spaced between the first and second end walls;

a first and second internal cavity separated by the center wall;

a first acoustical opening contained in the center wall providing acoustical communication between the first internal cavity and the exterior of the block;

a second acoustical opening contained in the second end wall providing acoustic communication between the second internal cavity and the exterior of the block, the width of the second end wall between the second acoustical opening and the back wall being substantially equal to the width of the first end wall;

a first angled front wall extending between the first end wall and the center wall at an acute angle with respect to the back wall; and a second angled front wall extending between the center wall and the second end wall at an acute angle with respect to the back wall, the second angled front wall being spaced from the first front wall by the first acoustical opening in the center wall.

25. A sound absorbing wall constructed to diffuse and absorb sound waves reaching the wall, the wall comprising:

a plurality of structural blocks positioned adjacent to each other, the structural blocks comprising:

a back wall;

a first and a second end wall contiguous with the back wall, each end wall being substantially perpendicular to the back wall and spaced from each other;

a center wall joined to the back wall and spaced between the first and second end wall, the back wall, the first and second end walls, and the center wall combining to form a first and a second internal cavity separated by the center wall, the center wall having a first acoustical opening contained therein providing acoustical communication between the first internal cavity and the exterior of the structural block, the second end wall having a second acoustical opening contained therein providing communication between the second internal cavity and the exterior of the block;

a first angled front wall extending between the first end wall and the center wall, the first angled front wall being positioned at an acute angle with respect to the back wall;

a second angled front wall extending between the center wall and the second end wall, the second angled front wall being positioned at an acute angle with respect to the back wall.

26. The acoustic wall of claim 25, wherein the first sidewall of the structural block has an upper and a lower portion, the lower portion having a length greater than the upper portion, the second end wall having an upper portion and a lower portion, the upper portion of the second end wall having a length extending between the back wall and the second acoustical opening contained in the second end wall, such that when a pair of structural blocks are positioned adjacent to one another, the upper portion of the first end wall corresponds in length to the upper portion of the second end wall, thereby allowing sound to enter the structural block through the second acoustical opening.

27. The wall of claim 25, further comprising a sound attenuator disposed in each internal cavity of the structural block, the sound attenuator being a mass of fibrous sound attenuating material.

28. The wall of claim 26, further comprising a lower rail extending between a lower portion of the first end wall and the lower portion of the second end wall;

a first angled inclined surface positioned between a lower rail and the first angled front wall; and a second angled inclined surface positioned between a lower rail and the second angled front wall, the first and second angled inclined surfaces acting to further diffuse sound contacting the structural block.

* * * * *